United States Patent [19]

Anthonijsz

[11] Patent Number: 4,698,034

[45] Date of Patent: Oct. 6, 1987

[54] WATER BICYCLE

[75] Inventor: Edwin M. C. Anthonijsz, Eindhoven, Netherlands

[73] Assignee: N.V. Lighttown Constructions, Eindhoven, Netherlands

[21] Appl. No.: 753,640

[22] Filed: Jul. 10, 1985

[51] Int. Cl.[4] ..... B63H 16/18

[52] U.S. Cl. ..... 440/27; 114/345; 114/352; 440/31

[58] Field of Search ..... 114/61, 345, 292, 283, 114/363, 352, 354; 440/26–31, 21; 297/311, 340, 344; 248/429

[56] References Cited

U.S. PATENT DOCUMENTS

| | | | |
|---|---|---|---|
| 623,774 | 4/1899 | Fenton | 297/311 |
| 1,627,876 | 5/1927 | Williams | 440/26 |
| 2,296,147 | 9/1942 | Cremer | 440/30 |
| 2,751,876 | 6/1956 | Ogilive | 440/25 |
| 2,800,150 | 7/1967 | Farwell, Sr. | 440/67 |
| 3,476,435 | 11/1969 | Hitzelberger | 248/429 |
| 3,479,980 | 11/1969 | Simmons | 114/283 |
| 4,063,320 | 12/1977 | Neumann | 114/345 |
| 4,294,184 | 10/1981 | Heinrich | 114/345 |

FOREIGN PATENT DOCUMENTS

| | | | |
|---|---|---|---|
| 522030 | 10/1953 | Belgium | 440/30 |

*Primary Examiner*—Jeffrey V. Nase
*Assistant Examiner*—Edwin L. Swinehart
*Attorney, Agent, or Firm*—Alan H. MacPherson; Richard Franklin; Thomas S. MacDonald

[57] ABSTRACT

A water bicycle comprising two relatively parallel, elongated floating bodies and a frame supported by said floating bodies provided with a seat whereby each of the floating bodies is provided with a frame part supported by the associated floating body and a spacing member is releasably arranged between the two frame parts for maintaining the frame parts at a given distance from the other and the floating bodies connected therewith, the seat being supported by an auxiliary frame provided with two guides cooperating with guides forming part of the frame parts on the floating bodies so that in the longitudinal direction of the floating bodies the guide parts are slidable over or in one another, while bolt are provided for fixing the guides in a desired position relative to one another.

8 Claims, 4 Drawing Figures

WATER BICYCLE

The invention relates to a water bicycle comprising two relatively parallel, elongated floating bodies and a frame supported by said floating bodies and provided with a seat.

The invention has for its object to obtain a water bicycle having a simple construction, which can be readily assembled and dismantled.

According to the invention each of the two floating bodies is provided with a frame part supported by said floating body and a spacing member releasably arranged between the two frame parts for maintaining the frame parts at a given distance from one another and the floating bodies connected therewith, while the seat is supported by an auxiliary frame having two guides, which cooperates with guides forming part of the frame parts arranged on the floating bodies in a manner such that in the longitudinal direction the guides can slide over the guides forming part of the frame parts or one in the other. Means are provided for fixing the guides in their desired, relative positions.

When using the construction according to the invention the floating bodies are guarded against a displacement apart from each other as soon as the guides forming part of the auxiliary frame of the seat and the guides forming part of the frame parts supported by the floating bodies have been assembled. By installing the seat assembly, the assembly of the various parts or the hydrocycle can thus simultaneously be maintained, while after the removal of the seat with the auxiliary frame the various parts of the water bicycle can be readily detached from one another.

The invention will be described more fully hereinafter with reference to a few embodiments of the construction embodying the invention schematically shown in the accompanying Figures.

Figure 1:
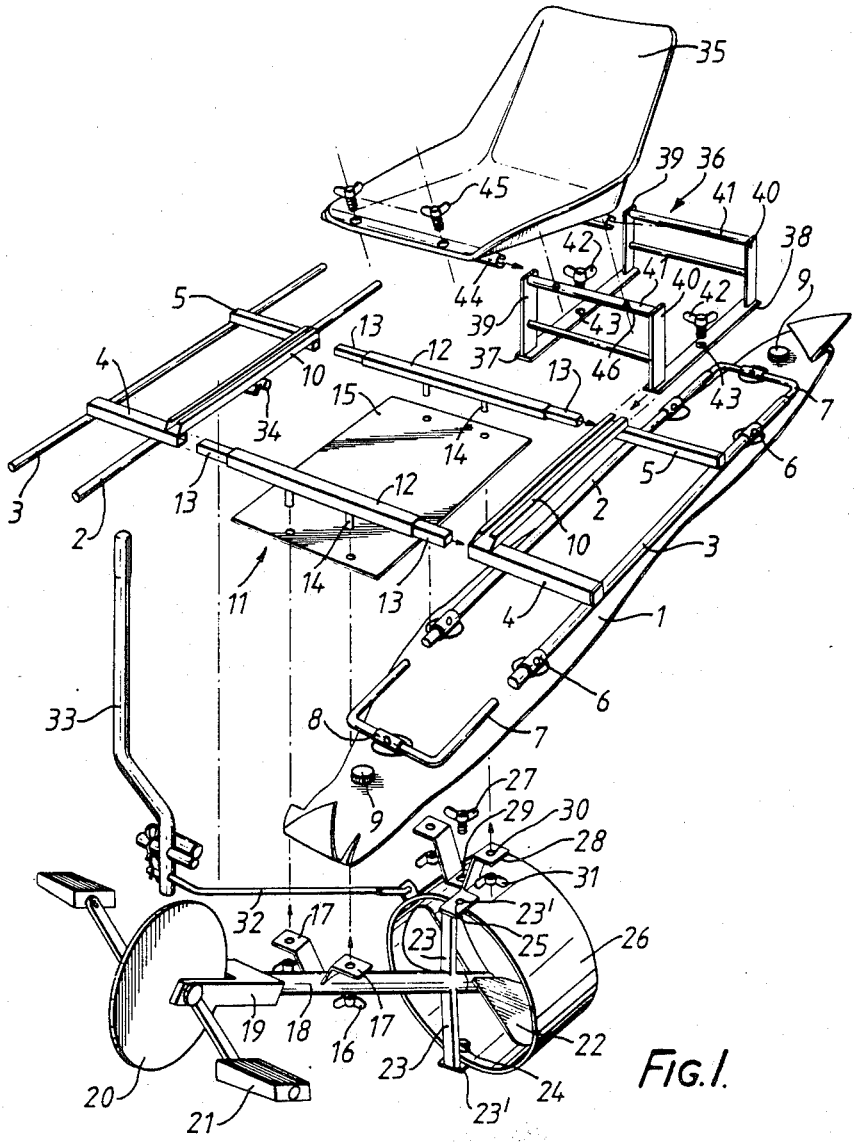
FIG. 1 is a schematic, perspective view of a oneperson water bicycle, in which the various parts of the water bicycle are shown at a distance from one another.

The water bicycle shown in FIG. 1 comprises two elongated, relatively parallel, inflatable floating bodies 1, only one of which is shown in the Figure.

On each of the floating bodies 1 is aranged a frame part comprising two relatively parallel, round tubes 2 and 3, which are interconnected with the aid of two connecting beams 4 and 5 extending at right angles to said tubes and having a square section in the embodiment shown. The tubes 2 and 3 are passed through sleeves 6 fastened to the floating bodies. The tubes 2 and 3 can freely slide in the sleeves in order to bring the frame parts into contact with further components in such a position that a favorable location of the center of gravity will be obtained. By inflating thereafter the flexible floating bodies 1, the walls of said bodies will be pressed against the tubes 2 and 3 for locking said tubes with respect to the bodies 1.

Furthermore the open ends of the relatively parallel tubes 2 and 3 slidably accommodate the limbs of U-shaped brackets 7. The central portion of each bracket is passed through a sleeve 8 fastened to a floating body 1.

The floating body 1 comprises an inner and an outer floating member and thus has two air chambers which can be inflated through air supply valves 9 arranged in the floating body. During inflation, the brackets 7 can freely slide in the tubes 2 and 3, but in the inflated state these brackets will provide the desired rigidity to the front and rear ends of the floating bodies respectively. When the floating bodies are emptied, the limbs of the brackets can be fully slid into the tubes 2 and 3 as is shown in FIG. 1 for the rear bracket 7 in order to obtain a compact transportable unit.

At the ends of the beams 4 and 5 of the frame parts arranged on the floating bodies, said ends facing one another as shown in FIG. 1, guides 10 are fastened parallel to the tubes 2 and 3. They have a substantially C-shaped cross section.

Furthermore a spacing member 11 is arranged between the floating bodies 1, and is provided with two relatively parallel beams 12, thinner ends of which can be slid into hollow beams 4 and 5, whose ends face one another and come into contact with the thicker parts of beams 12.

To the underside of beams 12 are fastened downwardly extending trunnion ends 14, over which is slid a plate 15 having matching holes.

To the foremost trunnion ends 14 wing nuts 16 clamp brackets 17 which are fastened to a tube 18. The fornt end of tube 18 has fastened to it a U-shaped bracket 19, in which a shaft bearing a bevel gear wheel 20 is journalled. The shaft is provided with pedals 21.

The bevel gear wheel 20 is in mesh with a bevel gear wheel (not shown) fastened to one end of a shaft journalled in the tube 18. The other end of said shaft is provided with a propeller screw 22. The end of the tube 18 located near the screw 22 is provided with two aligned arms 23, the ends of which are provided with horizontal ears 23'. To the lowermost ear 23' is fastened an upwardly extending trunnion 24 and the upper ear 23' has a hole 25. A cylindrical tunnel 26 surrounding the screw 22 is supported near its underside by the trunnion 24 arranged for this purpose in a hole in the cylindrical tunnel 26. On the top side, the cylindrical tunnel is supported by a bolt 27, which is in line with the trunnion 24 and passed through a hole 29 in the middle part of a bracket 28, through the hole 25 and through a hole in the cylindrical tunnel 26. It will be apparent that the disposition is such that the bolt 27 is in line with the trunnion 24, so that the cylindrical tunnel 26 can be turned about a vertical pivotal axis formed by the trunnion 24 and the bolt 27.

The bent free ends of the bracket 28 have holes 30, into which can be passed the trunnions 14 fastened to the hindmost beam 12 (FIG. 1) so that the bracket 28 and hence the cylindrical tunnel 26 at the rear end of the tube 18 can be fixed with the aid of wing nuts 31 to said rear beam.

At a distance from the pivotal axis formed by the trunnion 24 and the bolt 27 the cylindrical tunnel 26 has coupled with it the end of a coupling rod 32. The other end of the coupling rod is connected to a lever 33, which is pivotally coupled with the aid of a lug 34 to the frame part, which is arranged on the floating member (not shown) on the left-hand side. It will be obvious that by turning the lever 33 the cylindrical tunnel 26 can be turned so that it can, in addition, serve as a rudder.

For supporting a seat 35 the water bicycle is provided with an auxiliary frame 36. The auxiliary frame 36 comprises two relatively parallel slides 37 and 38 formed by rods having a rectangular section in the embodiment shown, to which are fastened upwardly extending strips 39 and 40 respectively. The strips 39 and 40 are interconnected by transverse beams 41.

The distance between the rods 37 and 38 is such that, when the beams 4 and 5 of the frame parts arranged on the floating bodies are slid over the thinner ends 13 of the beams 12, the slides 37 and 38 can be moved in the lengthwise direction of the floating bodies into the guides 10 of said frame parts. The rods 37 and 38 can be clamped in these guides 10 in any desired position with the aid of wing bolts 42 screwed into screw-threaded holes 43 in the slides 37 and 38.

It will be obvious that in this way the spacing member 11, which is connected in a readily detachable manner with the frame parts on the floating bodies, maintains these frame parts at the desired distance from one another, while the auxiliary frame part 36, which can be readily mounted and removed, counteracts, in the mounted state, a movement of the floating bodies from one another. The water bicycle is thus built up by a number of simply manufacturable, readily interconnectable and, respectively decouplable components.

Moreover, the seat 35 can be arranged and removed in a ready manner on the auxiliary frame 36 since on the underside the seat has fastened to it two guides 44 of C-shaped cross-sectional area, which can be pressed onto the top rods 41 and fixed thereto with the aid of wing bolts 45, which can be screwed into screw holes 46 in the foremost of the rods 41.

Figure 2:
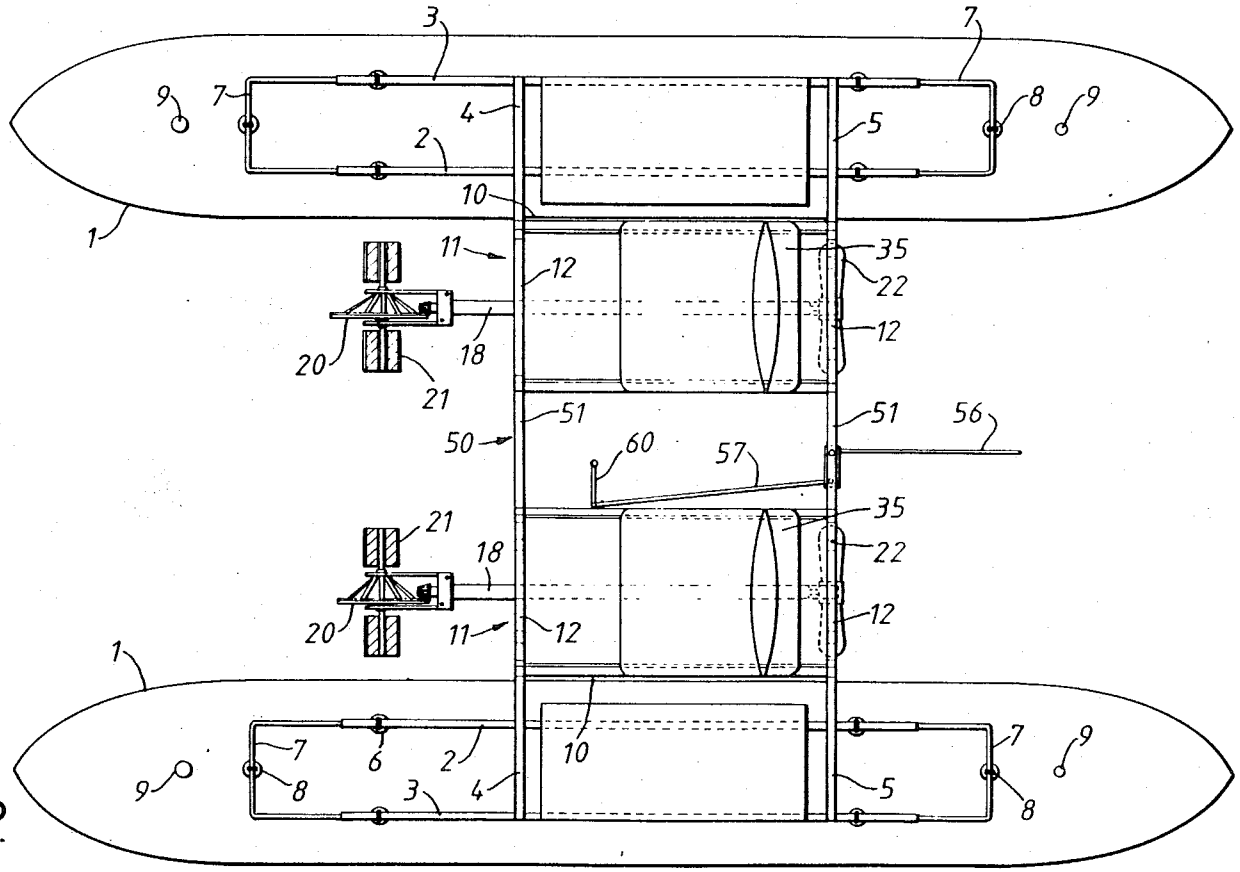
FIG. 2 is a plan view of an embodiment of a two-person water bicycle embodying the invention.
Figure 3:
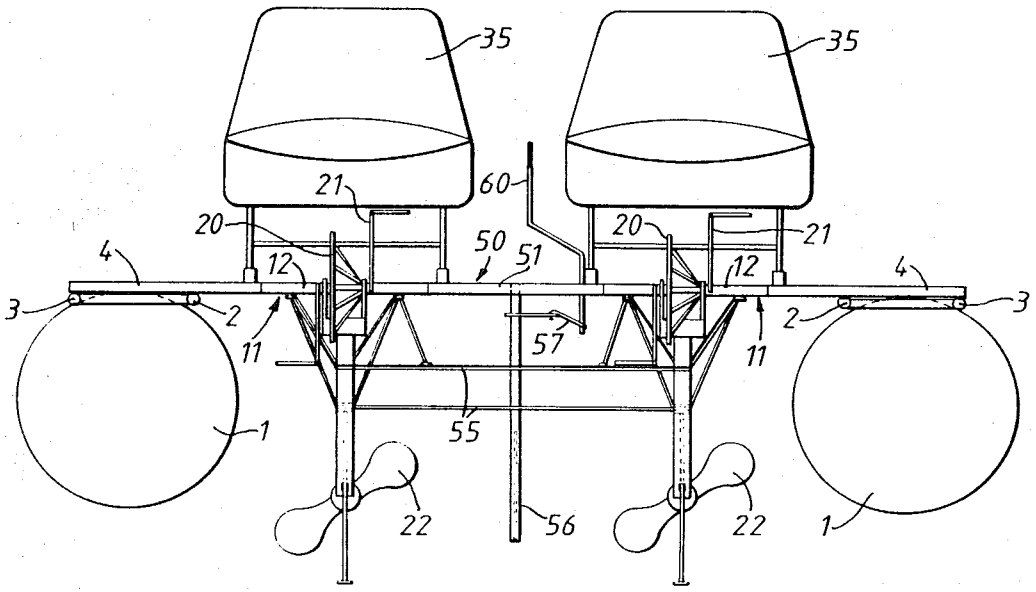
FIG. 3 is a front view of the water bicycle of FIG. 2.
Figure 4:
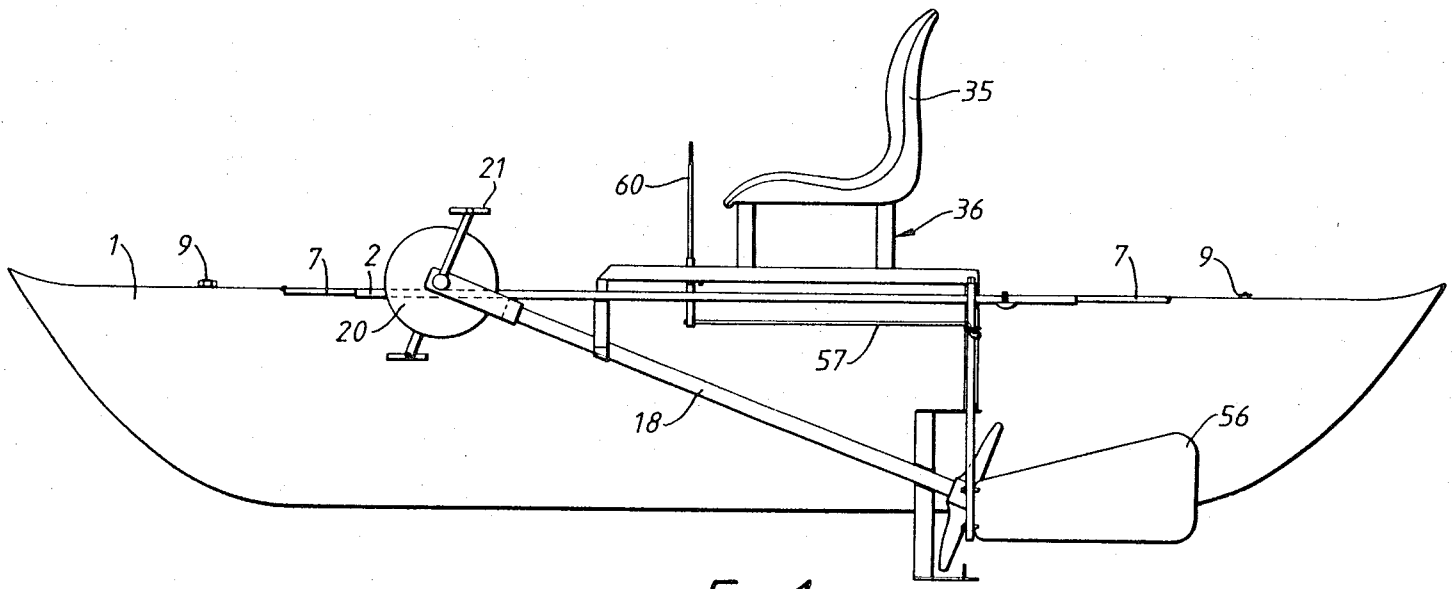
FIG. 4 is a cross-sectional view of the water bicycle of FIG. 2.

The water bicycle shown in FIGS. 2 to 4 is constructed for the major part from the same components as employed in the water bicycle shown in FIG. 1 and corresponding parts are, therefore, designated in the various Figures by the same reference numerals.

In particular it will be apparent from FIG. 2 that two spacing members 11 are used on a frame part connected with a floating body 1. Between these spacing members is arranged a further spacing member 50, which is provided with two relatively parallel beams 51 accommodating the thinner ends 13 of the two spacing members on both sides of the spacing member 50, which ends are facing one another. These two beams 51 on the middle spacing member 50, aligned to the beams 12 of the two spacing members 11, are interconnected by guide beams 53 extending at right angles to these beams 51. They have the same shape as the C-shaped guide beams 10.

From the Figures it will be furthermore apparent that each of these guide beams 53 holds a guide rod 37 of an auxiliary frame 36 so that also in this embodiment the various components of the water bicycle are guarded against displacement transverse of the longitudinal direction of the floating bodies 1 with the aid of the auxiliary frames 36 supporting the seats. In order to reinforce the assembly, additional brackets 55 (shown in FIG. 3) may be provided, which brackets can be fixed to the trunnion ends 17.

In this embodiment there is no screw tunnel serving as a rudder, but the middle spacing member 51 is provided with a rudder blade 56, which is connected through a coupling rod 57 with a rudder lever 60.

I claim:

1. A water bicycle comprising:

two relatively parallel, elongate floating bodies;

a frame supported by said floating bodies such that each of the floating bodies is provided with a frame part supported by the associated floating body and each frame part includes a first guide for receiving a second guide;

a spacing member releasably arranged between the two frame parts for maintaining the frame parts and the floating bodies connected thereto at a given distance from one another, wherein each frame part arranged on a floating body is provided with two hollow frame beams at right angles to the longitudinal direction of the floating body and the spacing member is provided with spacer frame beams extending in line with said hollow frame beams, the ends of said spacer frame beams being thinner than the center portions of said spacer frame beams, the thinner ends of said spacer frame beams being inserted into corresponding ends of said hollow frame beams;

a seat being supported by an auxiliary frame provided with two second guides for cooperating with the two first guides forming part of the frame parts on the floating bodies so that in the longitudinal direction of the floating bodies the second guides are secured to but slidable relative to the first guides; and means for fixing the second guides in a desired position relative to the first guides;

wherein said auxiliary frame holds said two relatively parallel elongated floating bodies to be no more than said given distance apart when said second guides are fixed relative to said first guides.

2. A water bicycle as claimed in claim 1 wherein each first guide of the frame part connected to the floating body has a C-shaped cross-sectional area and each second guide of the auxiliary frame is formed by a strip slidable in said C-shaped first guide.

3. A water bicycle as claimed in claim 1 wherein the seat is fastened to two C-shaped beams extending at right angles to the longitudinal direction of the floating bodies, said seat being mounted on said auxiliary frame by pressing each of said two C-shaped beams onto a corresponding rod forming part of the auxiliary frame.

4. A water bicycle as claimed in claim 1 wherein a tube supporting a shaft is releasably fastened with the aid of a bracket to the spacing member.

5. A water bicycle as claimed in claim 4 wherein the front end of the tube has fastened to it a pedal shaft, to which is fastened a gear wheel forming part of a bevel gear wheel transmission for driving the shaft.

6. A water bicycle as claimed in claim 5 wherein at the rear end of the tube a cylindrical tunnel surrounding a screw is pivotally coupled on a vertical pivotal axis.

7. A water bicycle according to claim 1 wherein said floating bodies are inflatable and said frame part is coupled to said floating body by means of sleeves so as to be shiftable in the longitudinal direction of the floating body when the floating body is empty, however is engaged by the floating body when the floating body has been inflated.

8. A water bicycle comprising:

two relatively parallel, elongated floating bodies;

a frame supported by said floating bodies such that each of the floating bodies is provided with a frame part supported by the associated floating body and each frame part includes a first guide for receiving a second guide;

at least one spacing member releasably arranged between the two frame parts for maintaining the frame parts and the floating bodies connected thereto at a given distance from one another;

two seats arranged side by side each on an auxiliary frame, each said auxiliary frame being provided with two second guides one of which cooperates with a corresponding one of the two first guides forming part of the frame parts on the floating bodies so that in the longitudinal direction of the floating bodies the second guides are secured to but slidable relative to the first guides, each seat being coupled with the aid of one of the second guides forming part of the auxiliary frame of the associated seat with one of the first guides forming part of the frame part arranged on one of the two floating bodies, while the other second guide of the auxiliary frame of the associated seat is placed in a corresponding one of two third guides arranged on a further spacing member located between spacing members joining the frame parts arranged on the two floating bodies, wherein the frame parts arranged on the floats and the various spacing members comprise components slidable into one another in a direction transverse of the longitudinal direction of the floats;

means for fixing the second guides in a desired longitudinal position relative to the first and third guides;

wherein said auxiliary frame holds said two relatively parallel elongated floating bodies to be no more than said given distance apart when said second guides are fixed relative to said first and third guides.

* * * * *